US008020695B2

(12) United States Patent
Brand

(10) Patent No.: US 8,020,695 B2
(45) Date of Patent: Sep. 20, 2011

(54) BASKET CARRIER

(75) Inventor: Kirsten Laura Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 53 days.

(21) Appl. No.: 12/018,448

(22) Filed: Jan. 23, 2008

(65) Prior Publication Data

US 2008/0210581 A1 Sep. 4, 2008

Related U.S. Application Data

(60) Provisional application No. 60/886,201, filed on Jan. 23, 2007.

(51) Int. Cl.
*B65D 75/00* (2006.01)

(52) U.S. Cl. ..... 206/183; 206/187; 206/193

(58) Field of Classification Search ..... 206/162, 206/170, 174, 175, 181, 173, 187, 188, 193, 206/180, 144, 183, 185, 527; 229/120.15, 229/120.17, 12.15
See application file for complete search history.

(56) References Cited

U.S. PATENT DOCUMENTS

| | | | | |
|---|---|---|---|---|
| 2,225,822 | A | | 12/1940 | Crook |
| 2,227,330 | A | | 12/1940 | Turner |
| 2,331,312 | A | | 10/1943 | Dorfman |
| 2,336,857 | A | | 12/1943 | Gies et al. |
| 2,460,108 | A | | 1/1949 | Smith et al. |
| 2,689,061 | A | | 9/1954 | Gray |
| 2,721,001 | A | * | 10/1955 | Hasselhoff ..... 229/120.17 |
| 2,776,072 | A | | 1/1957 | Forrer |
| 2,783,916 | A | | 3/1957 | Hodapp |
| 3,029,977 | A | | 4/1962 | Arneson |
| 3,053,411 | A | | 9/1962 | Struble et al. |
| 3,128,906 | A | | 4/1964 | Forrer |
| 3,190,487 | A | | 6/1965 | Wood |
| 3,191,800 | A | | 6/1965 | Kowal |
| 3,194,478 | A | | 7/1965 | Weiss |
| 3,229,849 | A | | 1/1966 | Spillson |
| 3,236,414 | A | | 2/1966 | Slevin, Jr. |
| 3,313,466 | A | * | 4/1967 | Keith ..... 229/120.15 |
| 3,343,742 | A | * | 9/1967 | Siegler ..... 229/120.36 |
| 3,432,073 | A | | 3/1969 | Forrer |
| 3,554,401 | A | | 1/1971 | Wood |
| 3,624,790 | A | | 11/1971 | Stout |

(Continued)

FOREIGN PATENT DOCUMENTS

DE 9004439 U1 6/1990

(Continued)

OTHER PUBLICATIONS

International Search Report and Written Opinion dated Jun. 23, 2010 for PCT/US2010/039607.

*Primary Examiner* — J. Gregory Pickett
*Assistant Examiner* — Kaushikkumar A Desai
(74) *Attorney, Agent, or Firm* — Womble Carlyle Sandridge & Rice, PLLC

(57) ABSTRACT

A carrier includes multiple rows of container receptacles on each side of a central handle. The bottom of the carrier is reinforced with web panels. The container receptacles can be separated by longitudinal and transverse separator panels. The top edge of the longitudinal separator panel can be curved to facilitate erection of the carrier.

20 Claims, 13 Drawing Sheets

U.S. PATENT DOCUMENTS 3,661,297 A 5/1972 Wood
3,669,306 A 6/1972 Forrer
3,672,539 A 6/1972 Forrer
3,721,335 A * 3/1973 Grant ..... 206/256
3,754,680 A 8/1973 Wood
3,784,053 A * 1/1974 Stout ..... 229/120.15
3,860,113 A 1/1975 Helms
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,153,158 A * 5/1979 Graser et al. ..... 206/173
4,171,046 A * 10/1979 Bonczyk ..... 206/193
4,205,748 A 6/1980 Wilson
4,217,983 A 8/1980 Stout
4,243,138 A 1/1981 Wilson
4,250,992 A 2/1981 Gilbert
4,253,564 A * 3/1981 Engdahl, Jr. ..... 206/187
4,308,950 A 1/1982 Wood
4,319,682 A 3/1982 Wright et al.
4,362,240 A 12/1982 Elward
4,374,561 A 2/1983 Stout et al.
4,406,365 A 9/1983 Kulig
4,413,729 A 11/1983 Wood
4,450,956 A 5/1984 Wood
4,480,746 A 11/1984 Wood
4,544,092 A * 10/1985 Palmer ..... 229/120.36
4,591,090 A * 5/1986 Collins et al. ..... 229/120.36
4,722,437 A 2/1988 Walsh
4,770,294 A 9/1988 Graser
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,191,976 A * 3/1993 Stout et al. ..... 206/162
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,579,625 A 12/1996 Olson et al.
5,590,762 A 1/1997 Harrelson
5,593,027 A 1/1997 Sutherland
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,695,051 A 12/1997 Hart
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,947,273 A 9/1999 Dalrymple et al.
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,341,689 B1 1/2002 Jones
6,371,287 B1 4/2002 Jones et al.
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,207,934 B2 4/2007 Schuster
7,374,038 B2 5/2008 Smalley
7,448,492 B2 11/2008 Sutherland
7,472,791 B2 1/2009 Spivey, Sr.
7,552,820 B2 6/2009 Kohler
7,604,116 B2 10/2009 Schuster
7,644,817 B2 1/2010 Sutherland
7,677,387 B2 3/2010 Brand et al.
7,762,395 B2 7/2010 Sutherland et al.
7,762,397 B2 7/2010 Coltri-Johnson et al.
7,793,780 B2 9/2010 Smalley
2002/0077236 A1 6/2002 Chalendar et al.
2002/0117407 A1 8/2002 Holley
2003/0159950 A1 8/2003 Jones et al.
2004/0050722 A1 3/2004 Schuster
2004/0094435 A1 5/2004 Auclair et al.
2005/0211577 A1 9/2005 Bakx
2005/0218014 A1 10/2005 Schuster
2005/0230273 A1 10/2005 Kohler
2006/0148629 A1 7/2006 Cuomo
2006/0157545 A1 7/2006 Auclair
2007/0151873 A1 7/2007 Schuster
2008/0210581 A1 9/2008 Brand
2010/0006458 A1 1/2010 Wilkins et al.

FOREIGN PATENT DOCUMENTS

EP 1 319 607 A1 6/2003
WO WO-97/05026 A1 2/1997

* cited by examiner

BASKET CARRIER

PRIORITY APPLICATION

This application claims the benefit of U.S. Provisional Application No. 60/886,201, filed Jan. 23, 2007, which application is incorporated by reference as if set forth herein in its entirety.

BACKGROUND

Basket carriers for accommodating bottles are known. Conventional basket carriers typically include a plurality of compartments or receptacles that may be separated by separator panels or straps. Such carriers can be adapted to carry various heavy contents such as beverages, so loads on the carrier bottom may be high. Conventional carriers may accordingly be limited in the number and/or size of containers that can be accommodated within the carriers. Also, the inclusion of separator panels to form the container receptacles may increase the difficulty of erecting the carriers.

SUMMARY

According to one exemplary embodiment of the present invention, a basket carrier is divided into a first section and a second section by a handle, with each carrier section having a first end, a second end, and an exterior side. At least the first section of the carrier comprises an end panel at the first end, an end panel at the second end, a side panel at the exterior side, a bottom panel, and separator panels dividing the first section of the carrier into a first plurality of receptacles. One or more reinforcing webs overlie the bottom panel to reinforce the carrier bottom. The reinforcing webs can be connected to one or more vertical side, end or handle panels. The reinforcing webs increase the load-bearing capacity of the carrier so that more and/or heavier containers can be accommodated within the carrier. The blank used to form the basket carrier can be wholly or partially symmetric, and the second section may therefore have a structure similar to that of the first section.

According to another aspect of the invention, a basket carrier includes a plurality of separator panels dividing each half of the carrier into a plurality of container receptacles. A longitudinal separator panel can have an upper edge with one or more curved sections separated by depressions. Transverse separator panels can have one or more curved sections along their lower edges. The curved sections of the longitudinal separator panels are designed to allow the transverse separator panels to pass over the longitudinal separator panels in order to facilitate erection of the basket carrier. In the erected basket carrier, the transverse separator panels can rest above and within the depressions in the longitudinal separator panels to restrict movement of the transverse separator panels within the basket carrier. The stability of the carrier is thereby increased, and containers are more securely retained within the container receptacles.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale.

Dimensions of various features and elements in the drawings may be expanded or reduced to more clearly illustrate the embodiments of the invention.

DETAILED DESCRIPTION

The present invention generally relates to a basket carrier suitable for storing, carrying and dispensing articles such as, for example, bottle beverage containers. Articles accommodated within the present basket carrier embodiments can include containers such as, for example, petaloid bottle containers, beverage cans, glass bottles, plastic bottles, or other containers such as, for example, those used in the packaging of foodstuffs. For the purposes of illustration and not for the purpose of limiting the scope of the present invention, the following detailed description describes bottle beverage containers as disposed within the basket carrier embodiments.

In this specification, the terms "bottom," "side," and "end" indicate orientations determined in relation to fully erected, upright basket carriers. The terms "side" and "end" are not used to imply any relative size difference between panels described as "end panels" or "side panels," unless such limitation is specifically recited in the claims.

Figure 1:
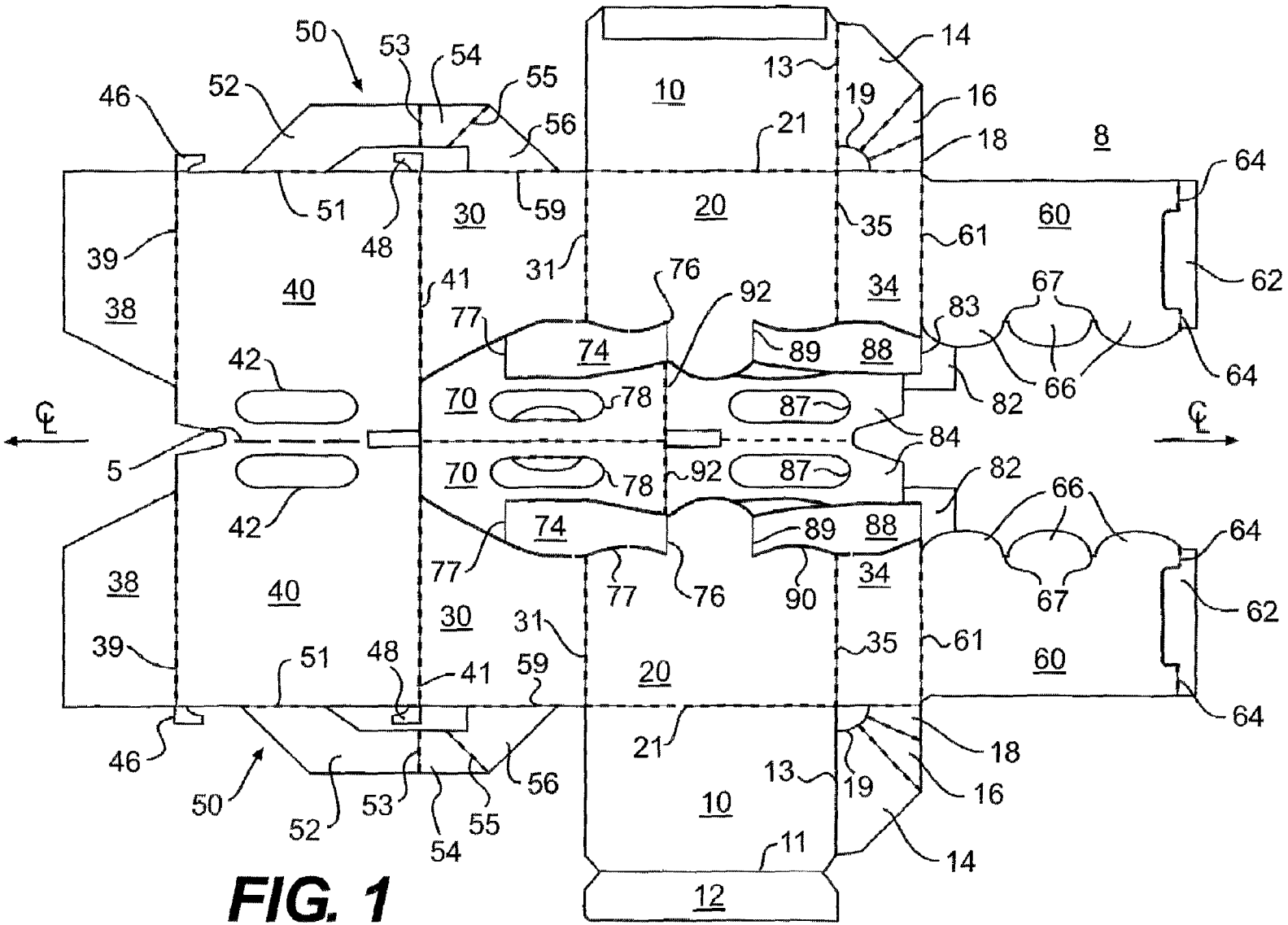
FIG. 1 is a plan view of the print or exterior side of a blank used to form a basket carrier according to a first embodiment of the invention.
Figure 2:
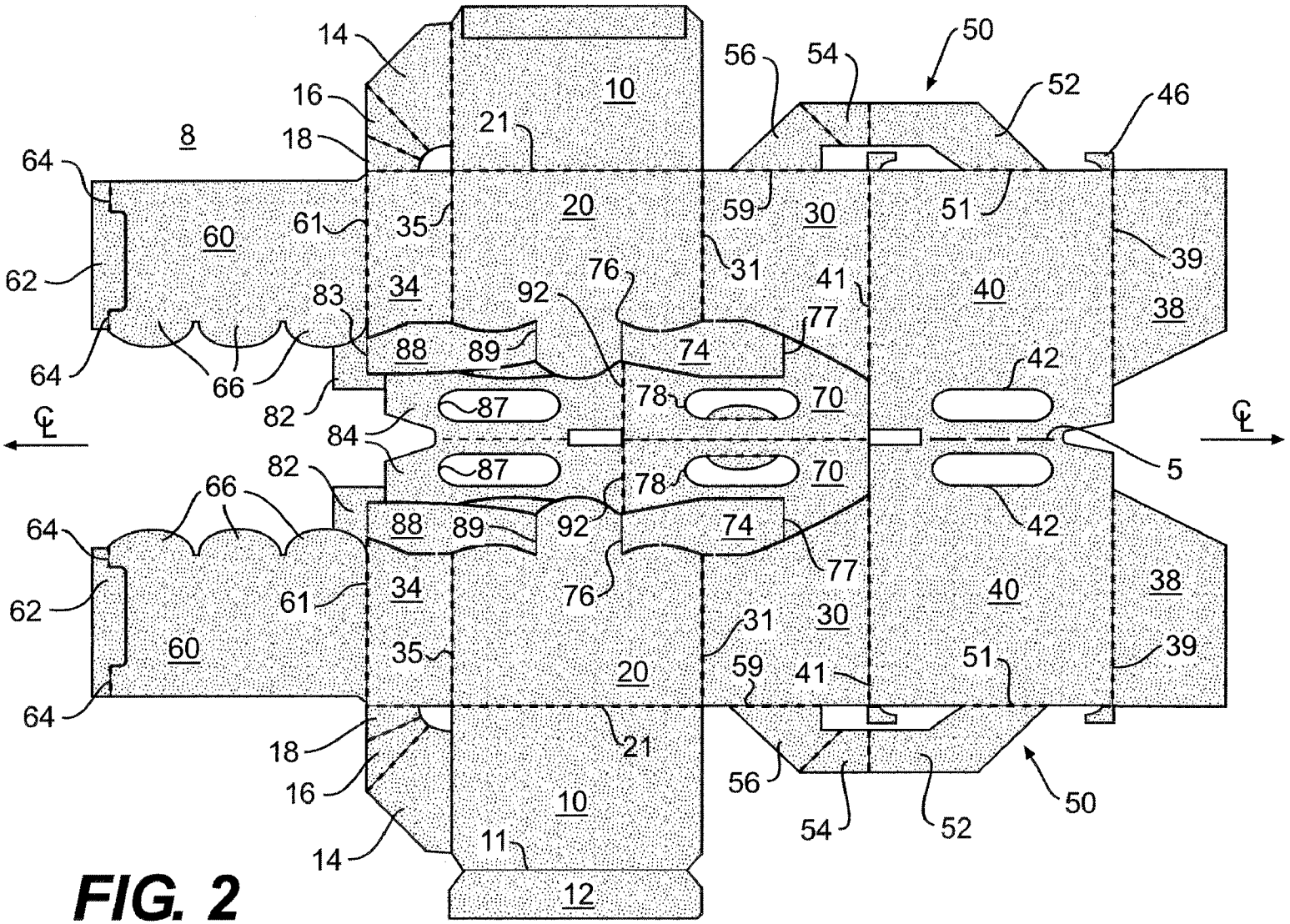
FIG. 2 is a plan view of the interior or under side of the blank illustrated in FIG. 1.
Figure 13:
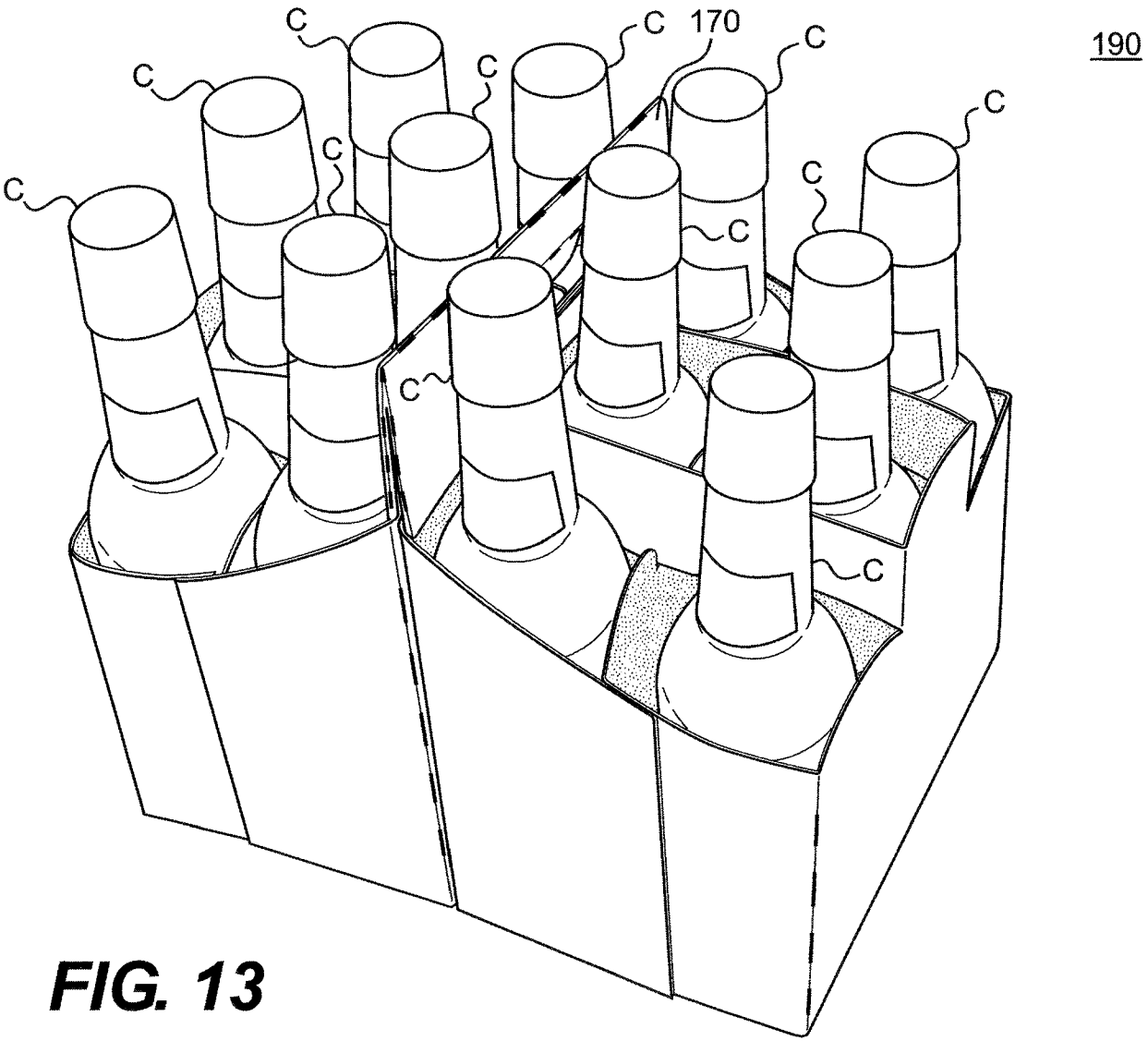
FIG. 13 illustrates the erected basket carrier loaded with beverage containers.

FIG. 1 is a plan view of the print or exterior side of a blank 8 used to form a basket carrier 190 (illustrated in FIGS. 7-9) according to a first embodiment of the invention. FIG. 2 illustrates the interior or underside of the basket carrier blank 8. The basket carrier 190 may be loaded with containers C, as shown in FIG. 13. As shown in FIG. 1, the blank 8 may be symmetric or nearly symmetric about a longitudinally extending centerline $C_L$. Therefore, certain elements in the drawing figures may have identical reference numerals in order to reflect the partial or complete longitudinal symmetries in the blank 8. Further, for the sake of brevity, the symmetry of the blank 8 allows much of the description of the blank 8 to be described below with respect to the elements on one side of the longitudinal centerline $C_L$.

In the figures, as shown in FIG. 2, the underside of the blank 8 is illustrated with light stippling in order to distinguish the underside from the upper, print side of the blank 8.

Referring to FIGS. 1-2, on each side of a central fold line 5, which is aligned with the longitudinal centerline $C_L$, the blank 8 comprises a bottom panel 10, a side panel 20 foldably connected to the bottom panel 10 at a longitudinal fold line 21, a first end panel 30 foldably connected to one side of the side panel 20 at a transverse fold line 31, a second end panel 34 foldably connected to the other side of the side panel 20 at a transverse fold line 35, a major handle panel 40 foldably connected at one side to the first end panel 30 at a transverse fold line 41, and a third end panel 38 foldably connected to the other side of the major handle panel 40 at a transverse fold line 39. An adhesive panel 12 may be connected to one of the bottom panels 10 at a longitudinal fold line 11. The major handle panels 40 include "racetrack" handle apertures 42, with a pair of hook projections 46, 48 extending outwardly from each major handle panel 40.

Still referring to FIGS. 1-2, on each side of a central fold line 5, a longitudinal separator panel 60 is foldably connected to the second end panel 34 at a transverse fold line 61, an exterior handle panel 70 is foldably connected to the side panel 20 at a transverse fold line 76, and an interior handle panel 84 is foldably connected to the exterior handle panel 70 at a transverse fold line 92. Each longitudinal separator panel 60 includes an adhesive panel 62 foldably connected at a pair of transverse fold lines 64. A first transverse separator panel 74 is foldably connected to the side panel 20 at a transverse fold line 76, and to the exterior handle panel 70 at a transverse fold line 77. The longitudinally extending portions of the transverse separator panels 74 bordering the panels 20, 30 can be defined in part by breachable lines of disruption, such as cuts interrupted by nicks. A second transverse separator panel 88 is foldably connected to the side panel 20 at a transverse fold line 89, and to an adhesive panel 82 at a transverse fold line 83. The longitudinally extending portions of the transverse separator panels 88 bordering the panels 20, 34 can be defined in part by breachable lines of disruption, such as cuts interrupted by nicks. The exterior handle panels 70 include handle apertures 78, and the interior handle panels 84 include handle apertures 87.

According to one exemplary aspect of the invention, each bottom panel 10 may be connected to an adjacent second end panel 34 by a plurality of foldably connected reinforcing gusset or web panels 14, 16, 18. The web panel 14 is foldably connected to the bottom panel 10 at a transverse fold line 13, and the web panel 18 is foldably connected to the second end panel 34 at the longitudinal fold line 21. An aperture 19 is struck from the blank 8 at the junction of the interior edges of the panels 14, 16, 18, 10, 34. A reinforcing strap or web 50 is foldably connected to each major handle panel 40 at a longitudinal fold line 51, and to each first end panel 30 at a longitudinal fold line 59. Each reinforcing strap 50 includes a plurality of interconnected web panels 52, 54, 56 foldably connected at fold lines 53, 55. The web panel 52 is foldably connected to the major handle panel 40 at the longitudinal fold line 51, and the web panel 56 is foldably connected to the first end panel 30 at the longitudinal fold line 59. The web panels 14, 16, 18, 52, 54, 56 serve to reinforce the bottom of the erected basket carrier 190 (illustrated in FIGS. 7-9).

According to another exemplary aspect of the invention, the longitudinal separator panels 60 include a series of spaced curved upper projections 66 separated by notches or cutout depressions 67. The upper projections 66 can have a convex arched or arcuate shape that face upwardly in the erected carrier. The first transverse separator panels 74 may have concave curved or recessed lower edge portions 77, and the second transverse separator panels 88 include concave curved or recessed lower edge portions 90. The lower edge portions 77, 90 face downwardly in the erected carrier. The recessed and curved portions of the separator panels 60, 74, 88 facilitate erection of the carrier, as discussed in further detail below.

An exemplary method of erecting the blank 8 into the basket carrier 190 is discussed below with reference to FIGS. 2-8.

Figure 3:
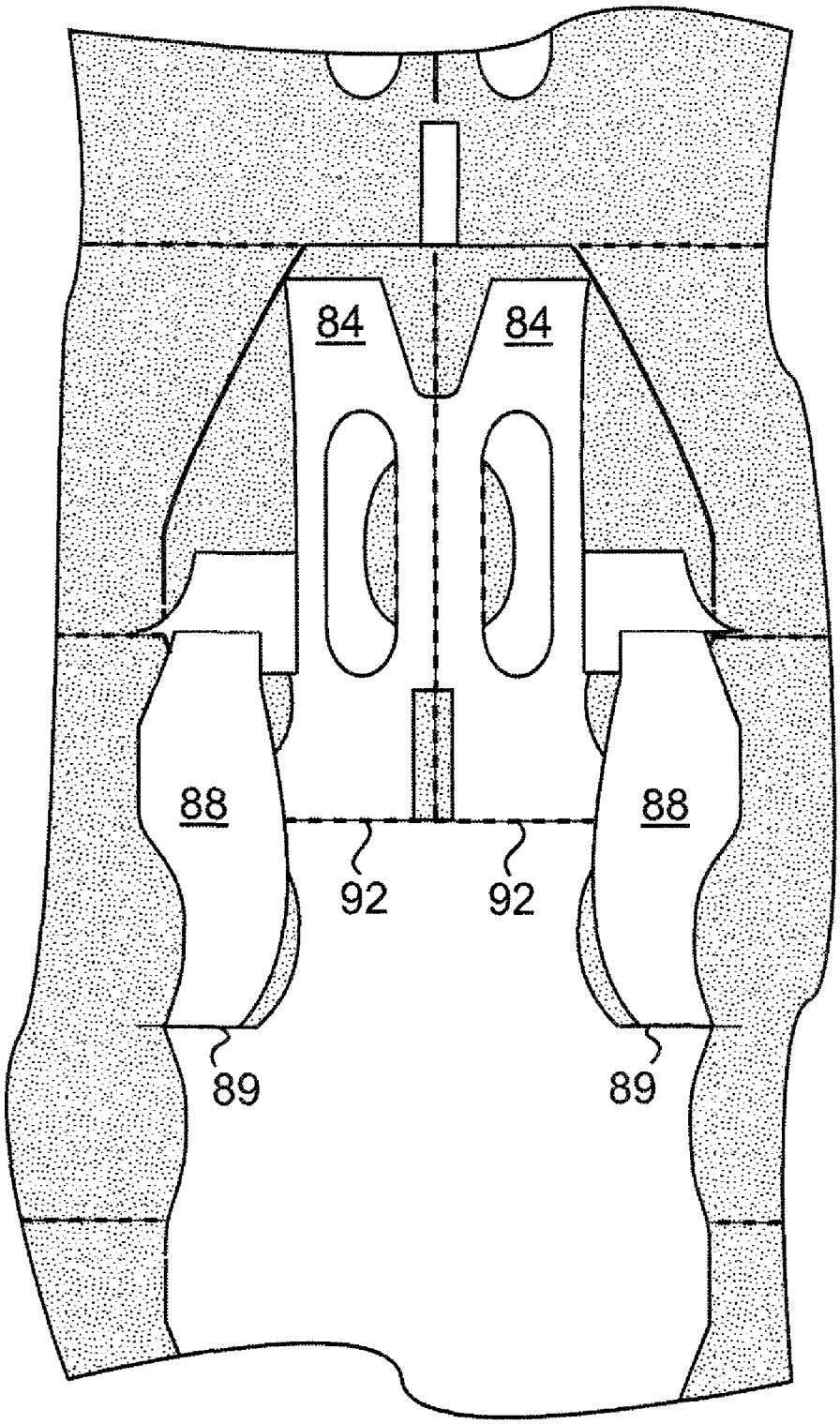
FIG. 3 illustrates folding and gluing steps during erection of the blank of FIG. 1 into a basket carrier.

Referring to FIG. 2, beginning with the blank 8 interior or underside (i.e., the stippled side) facing up, glue or other adhesive may be applied to the interior sides of the interior handle panels 84 and/or to the interior sides of the exterior handle panels 70. Referring to FIG. 3, the interior handle panels 84 are folded over flat about the transverse fold lines 92, and the second transverse separator panels 88 are folded over flat about the transverse fold lines 89. The underside of each interior handle panel 84 is thereby adhered to the underside of a respective exterior handle panel 70.

Figure 4:
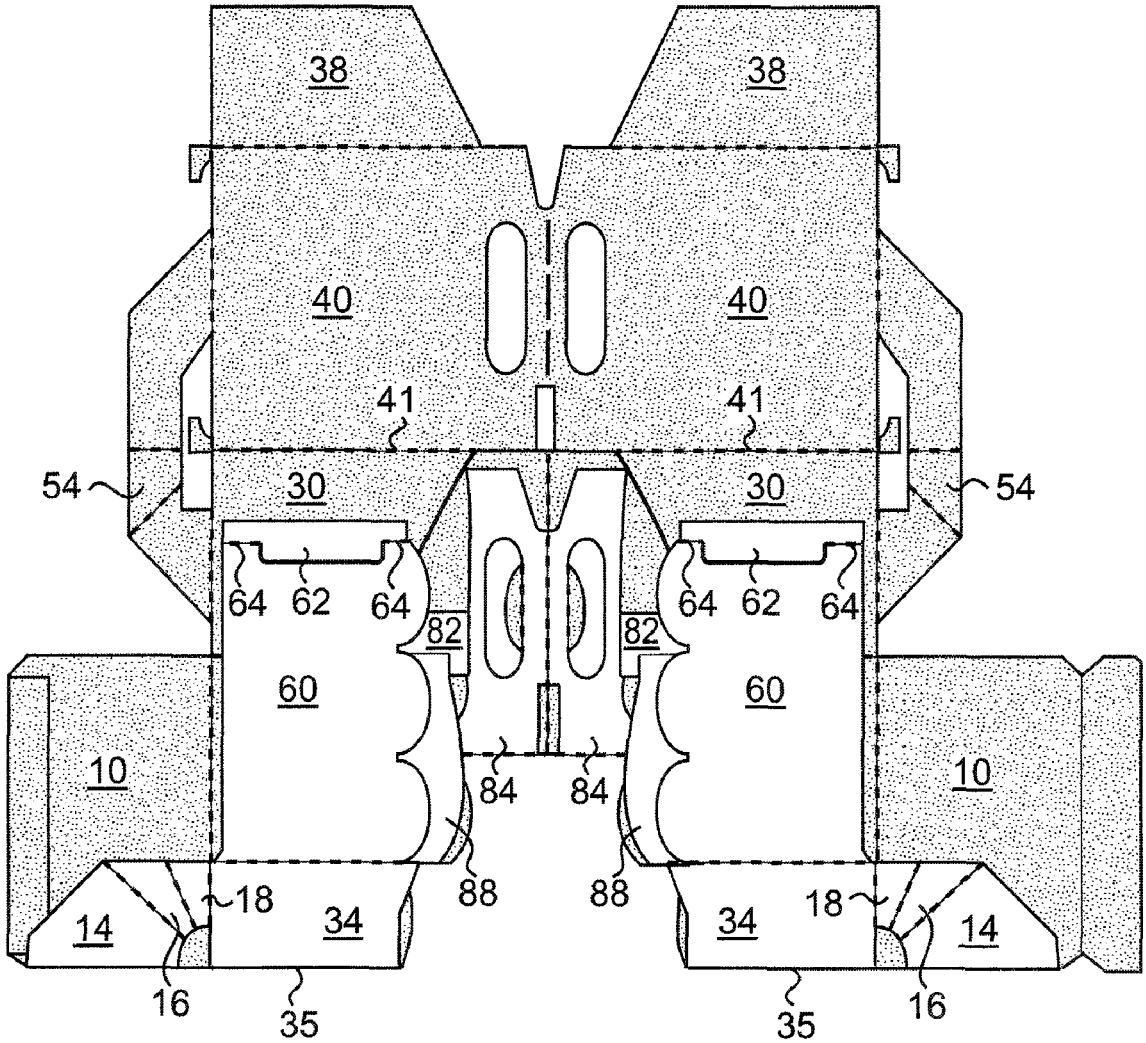
FIG. 4 illustrates folding and gluing during erection of the basket carrier.

Glue or other adhesive may be applied to the undersides of the web panels 14 and to the adhesive panels 62 of the longitudinal separator panels 60. Referring to FIG. 4, the blank 8 is folded over flat at the transverse fold lines 35 so that each adhesive panel 62 is adhered to a respective first end panel 30, and each web panel 14 is adhered to an adjacent bottom panel 10.

Figure 5:
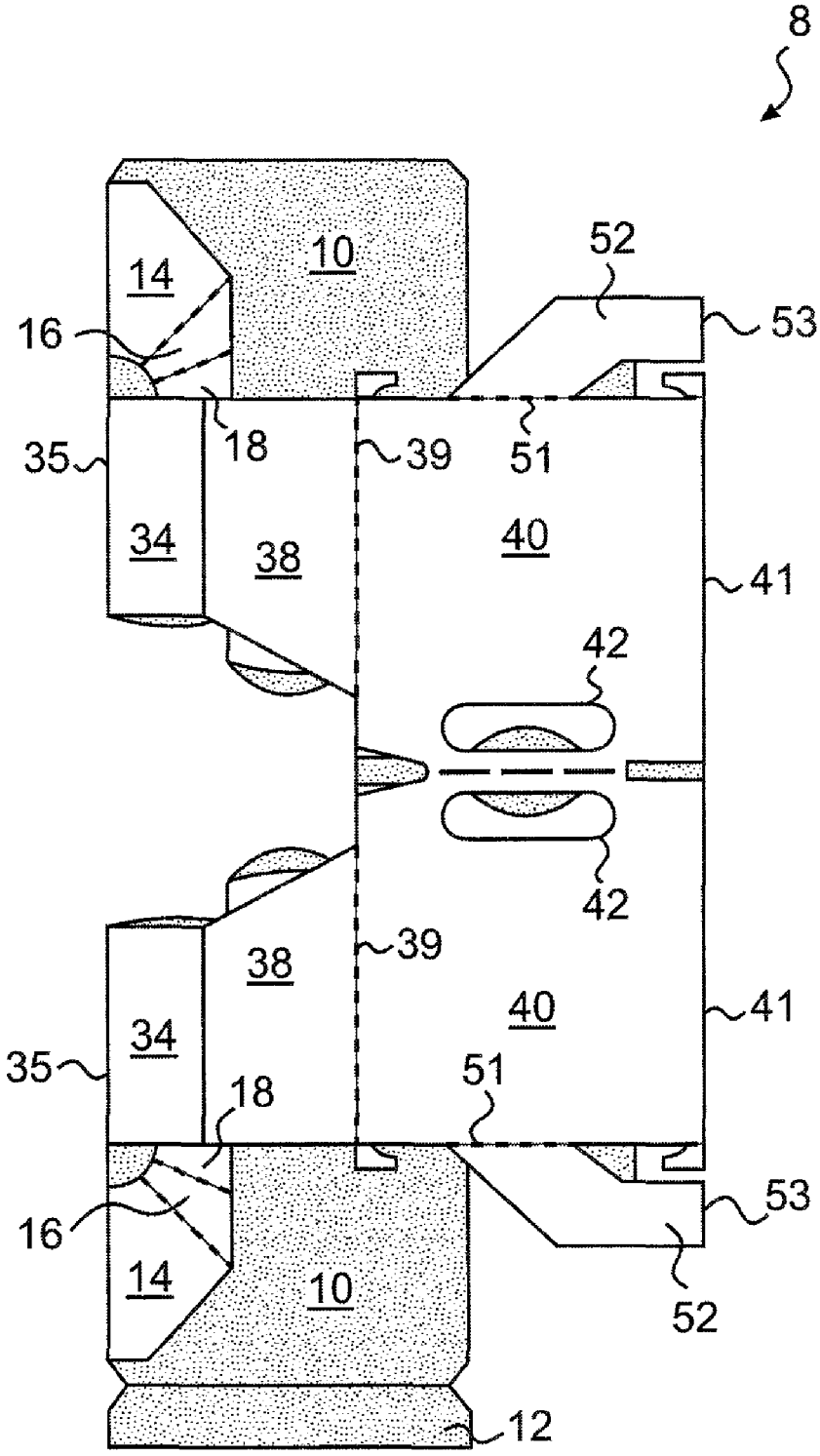
FIG. 5 illustrates folding and gluing during erection of the basket carrier.

Glue or other adhesive may be applied to the exterior sides of the interior handle panels 84 and the adhesive panels 82. Adhesive is also applied to the interior sides of the web panels 54 and the distal edges (at the top of the blank in FIG. 4) of the third end panels 38. Referring to FIG. 5, the blank is folded over flat about the transverse fold lines 41, 53. Each web panel 52 is adhered to an adjacent web panel 54, and each major handle panel 40 is adhered to a respective interior handle panel 84 and to an adhesive panel 82, which is foldably connected to a second transverse separator panel 88. The distal interior side edge of each third end panel 38 is adhered to the exterior side of a respective second end panel 34.

Figure 6:
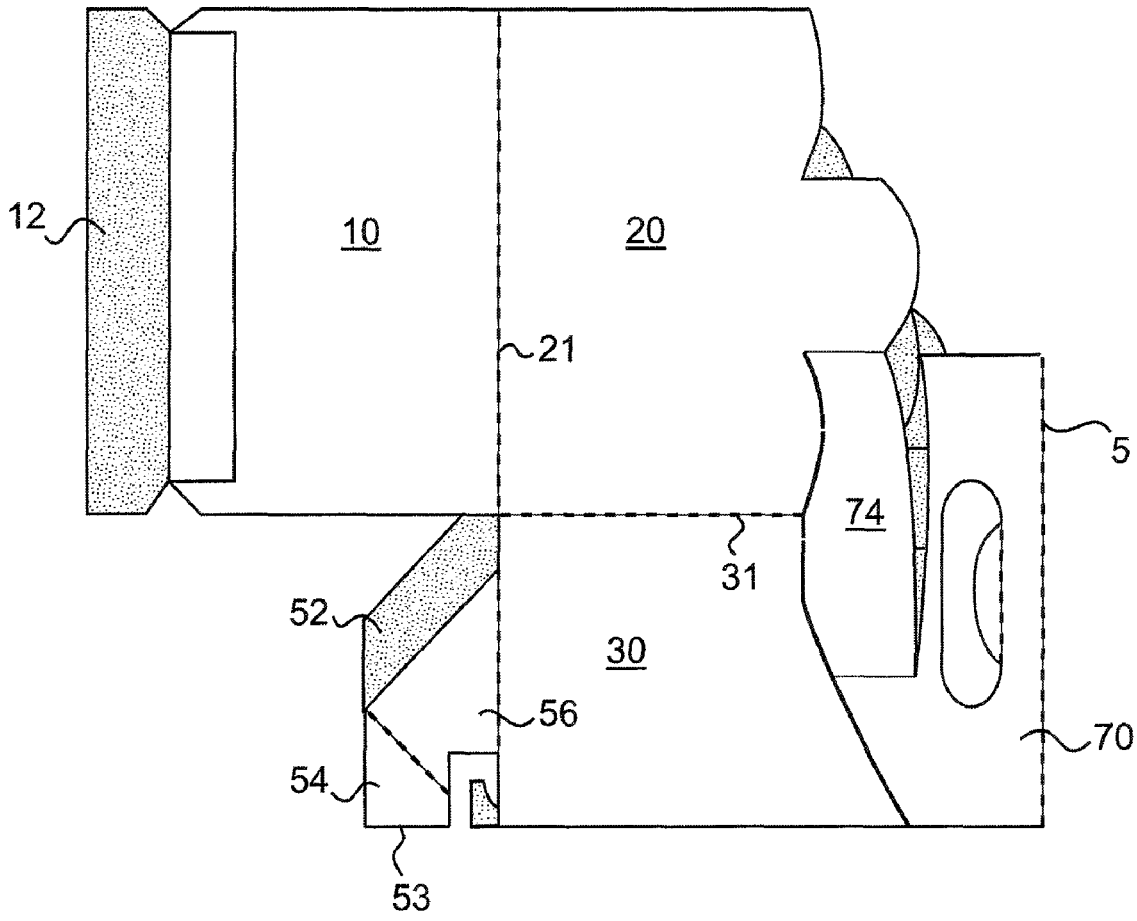
FIG. 6 illustrates folding and gluing during erection of the basket carrier.

Glue or other adhesive may be applied to the exterior sides of one or both of the major handle panels 40. Referring to FIG. 6, the blank is folded flat about the central fold line 5 so that the major handle panels 40 are adhered together. The adhesive panel 12 of one bottom panel 10 is then folded over flat about the longitudinal fold line 11, and the underside of the adhesive panel 12 is adhered to the opposite bottom panel 10.

Figure 7:
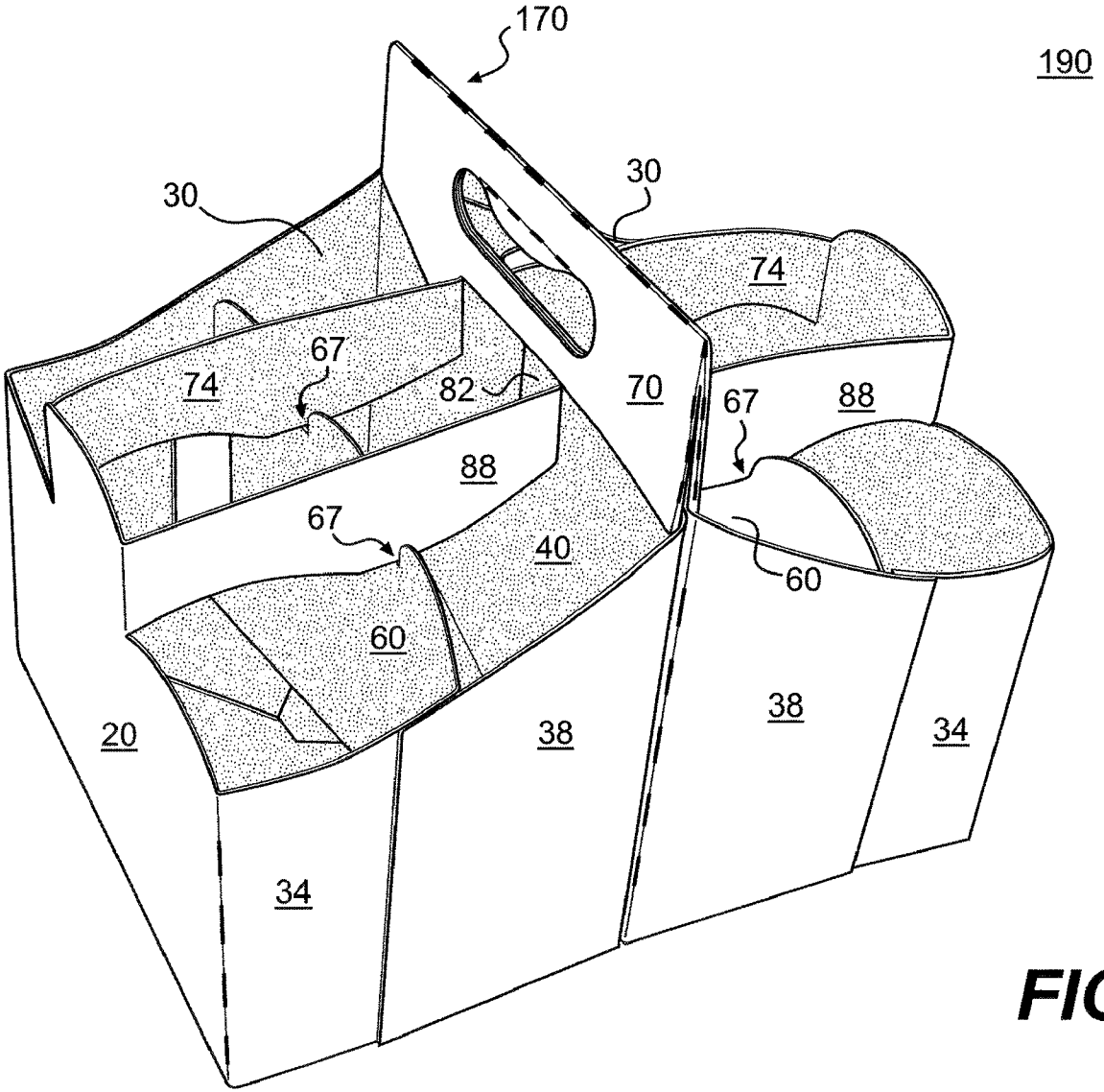
FIG. 7 illustrates a perspective view of the erected basket carrier viewed from an end and a first side of the carrier, wherein the first side of the carrier is a mirror image of the second side of the carrier.
Figure 8:
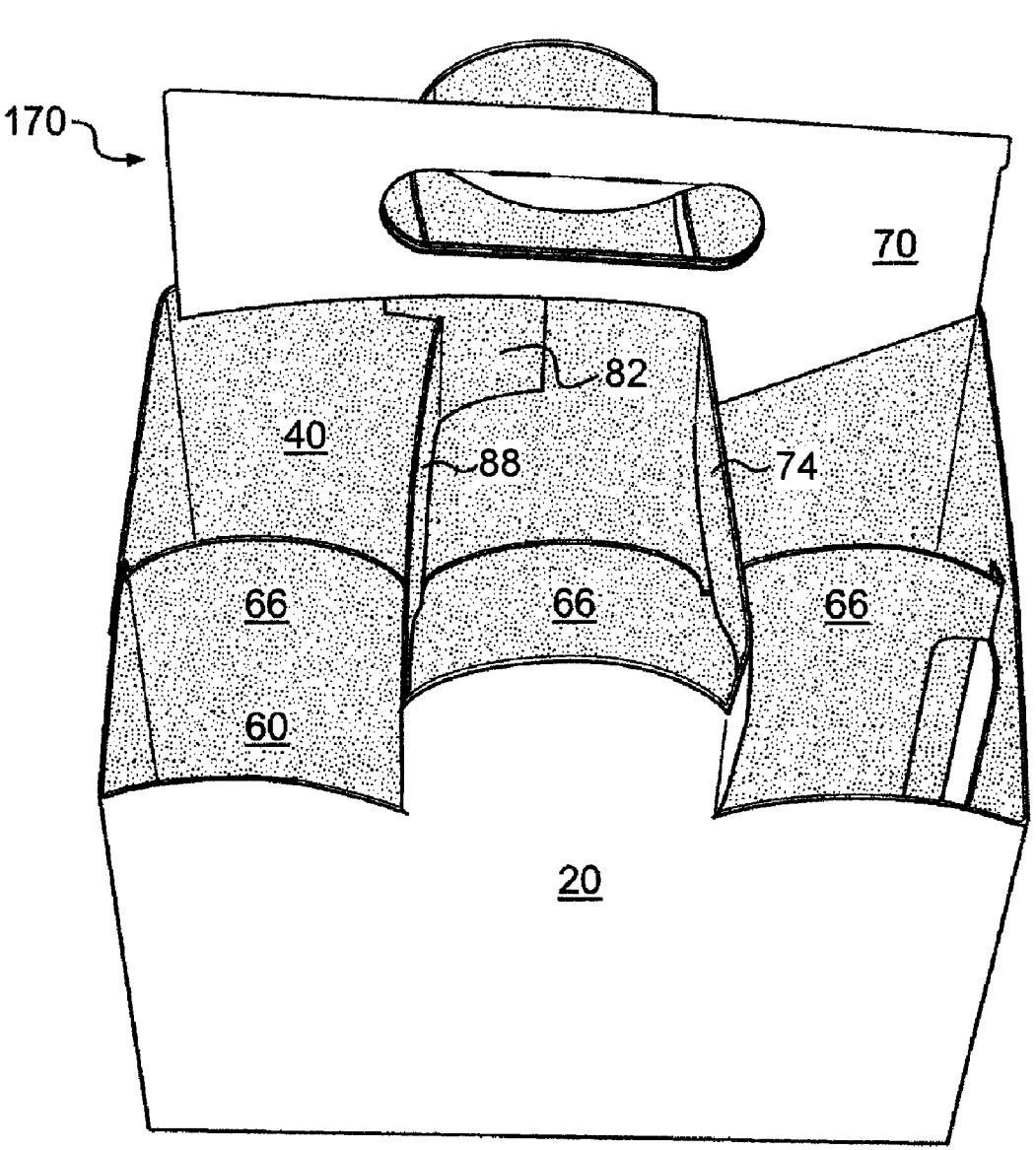
FIG. 8 is a perspective view of the basket carrier viewed from the second side of the carrier.
Figure 9:
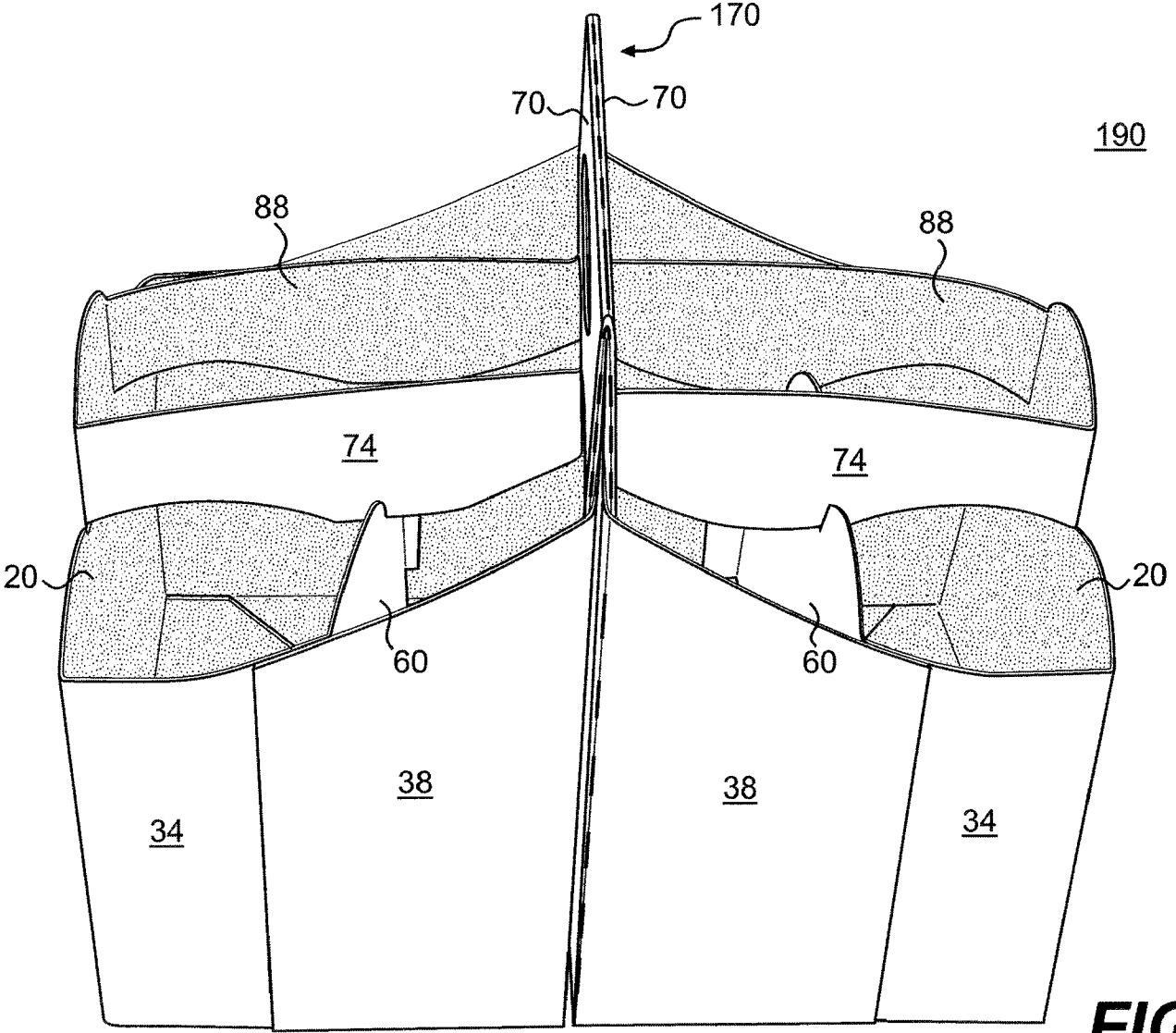
FIG. 9 is a perspective view of the basket carrier viewed from an end of the carrier.

Referring to FIGS. 7-9, the folded and glued blank 8 illustrated in FIG. 6 is opened up to form the basket carrier 190. The overlapping handle panels 40, 70, 84 form a multi-ply handle 170 that divides the carrier 190 into two halves or sections. The upright major handle panels 40 extend generally vertically or upwardly from the bottom of the carrier 190, while the handle panels 70, 84 reinforce an upper section of the handle 170. The transverse separator panels 74, 88 and the longitudinal separator panels 60 in part define twelve container receptacles in the carrier 190, six on each side of the handle 170. On each side of the handle 170, the container receptacles are arranged in two rows and three columns, which are partially defined by the transverse separator panels 74, 88 and the longitudinal separator panel 60. The panels 20, 30, 34, 38 40, 60, 70, 74, 84, 88 are arranged generally upright or vertically in the carrier 190.

Still referring to FIGS. 7-9, each first transverse separator panel 74 is foldably connected at one end to an exterior handle panel 70, and at the other end to a side panel 20. Each second transverse separator panel 88 is connected at one end to a major handle panel 40 via an adhesive panel 82, and foldably connected at the other end to a side panel 20. Each longitudinal separator panel 60 is foldably connected at one end to a second end panel 34 and adhered at the other end to a first end panel 30 via an adhesive panel 62. According to one aspect of the invention, the convex arched curvatures of the tops of the longitudinal separator panels 60 at the upper projections 66, and the concave curvatures 77, 90 (FIG. 1) at the lower edges of the transverse separator panels 74, 88, respectively, allow the transverse separator panels 74, 88 to easily slide or pass over the longitudinal separator panels 60 as the carrier is opened up. Referring to FIG. 7, the transverse separator panels 74, 88 can rest within the recesses 67 in the longitudinal separator panels 60, restricting the movement of the transverse separator panels 74, 88, thereby adding stability and rigidity to the carrier 190. The stability of the container receptacles defined by the separator panels 60, 74, 88 is also increased.

Figure 10:
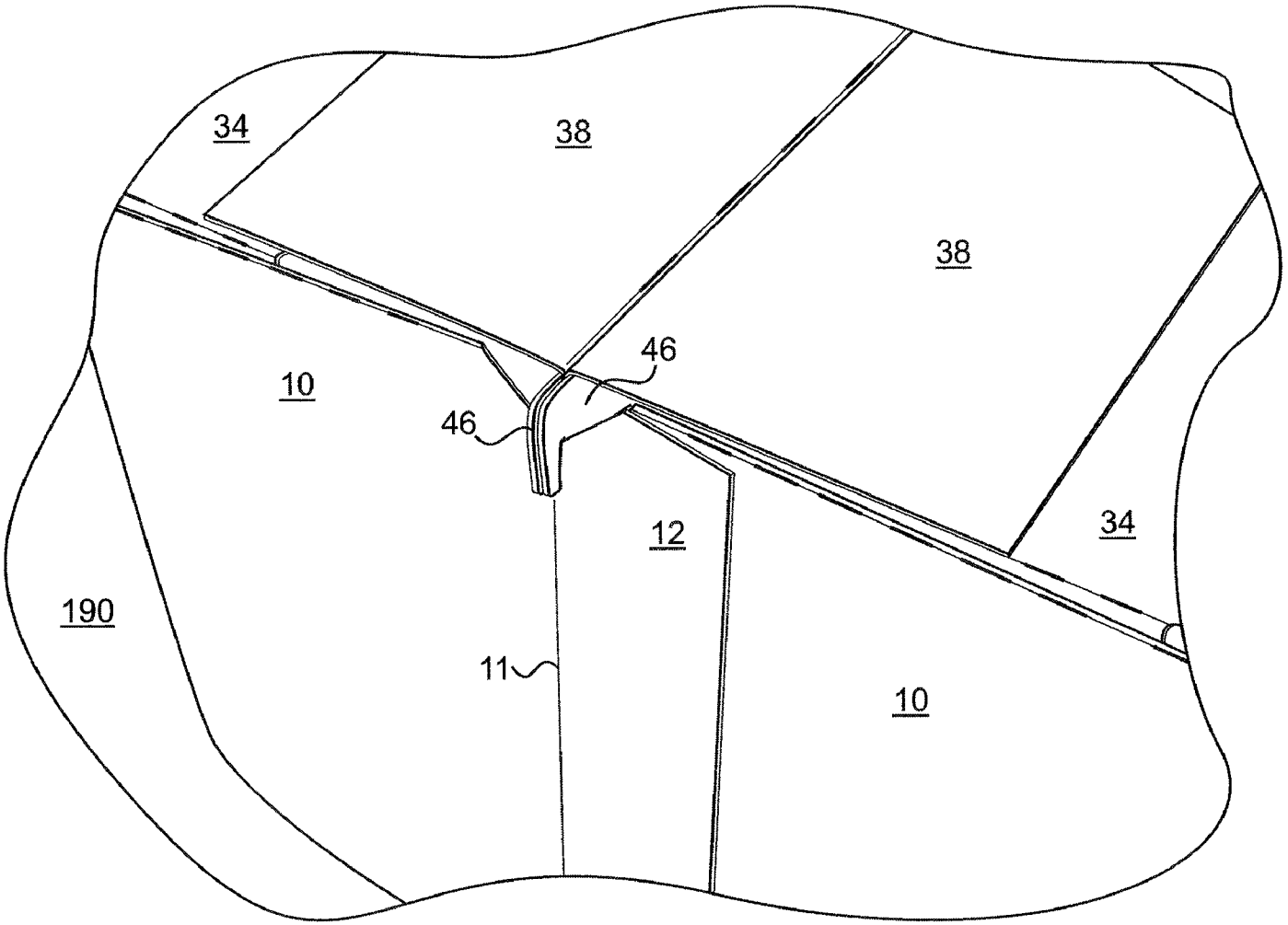
FIG. 10 is a partial view of a bottom portion of one end of the basket carrier.

FIG. 10 illustrates a portion of one end of the bottom of the basket carrier 190. As shown in the figure, the adhesive panel 12 adheres one bottom panel 10 to the opposite bottom panel 10. The hook projections 46 on the major handle panels 40 project downwardly and engage V-shaped notches at each end of the crease line 11. At the other end of the carrier 190, the hook projections 48 (shown in FIG. 1) similarly engage the bottom panels 10.

Figure 11:
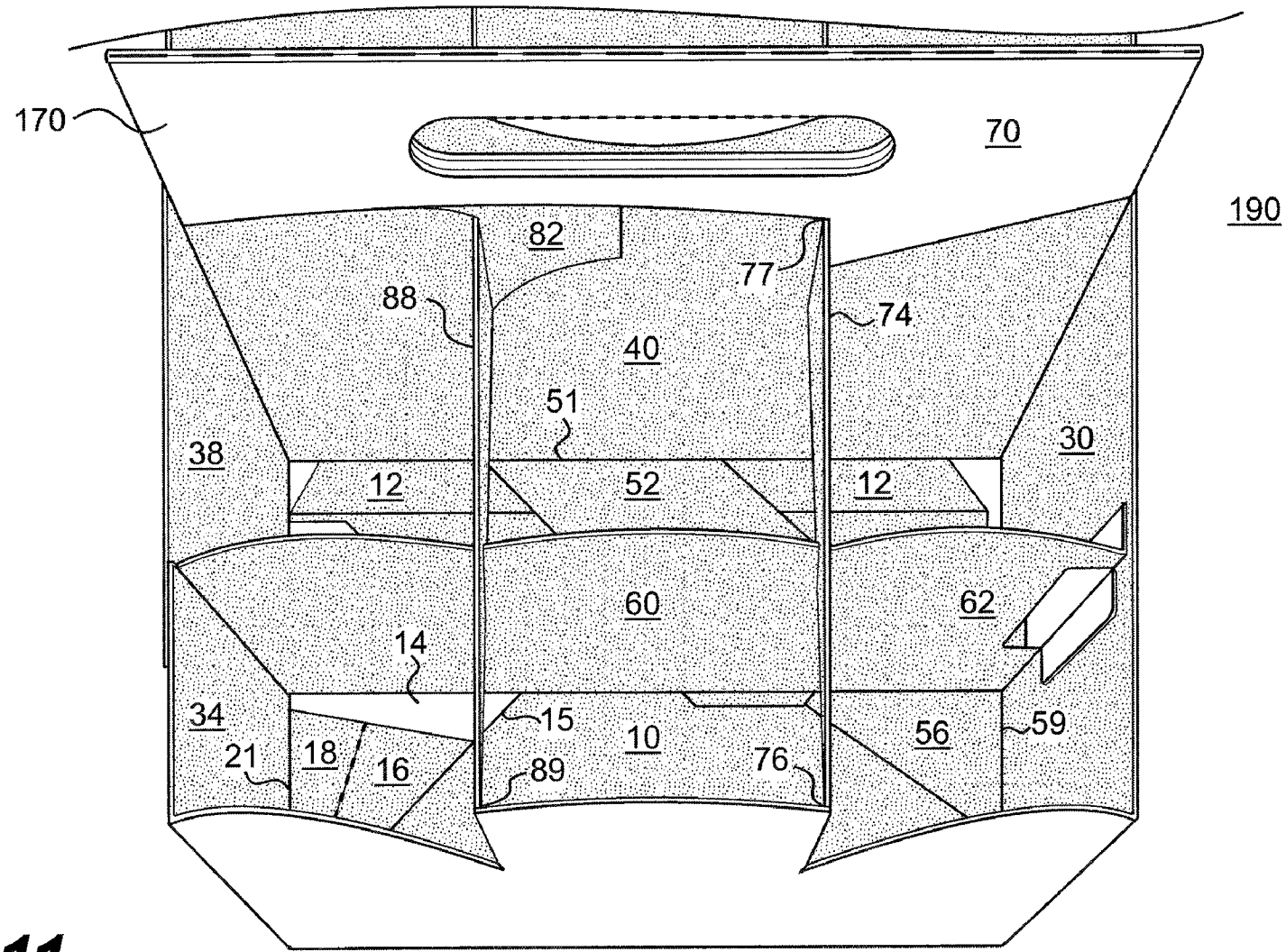
FIG. 11 is a partial view of the container receptacles on one side of the basket carrier.
Figure 12:
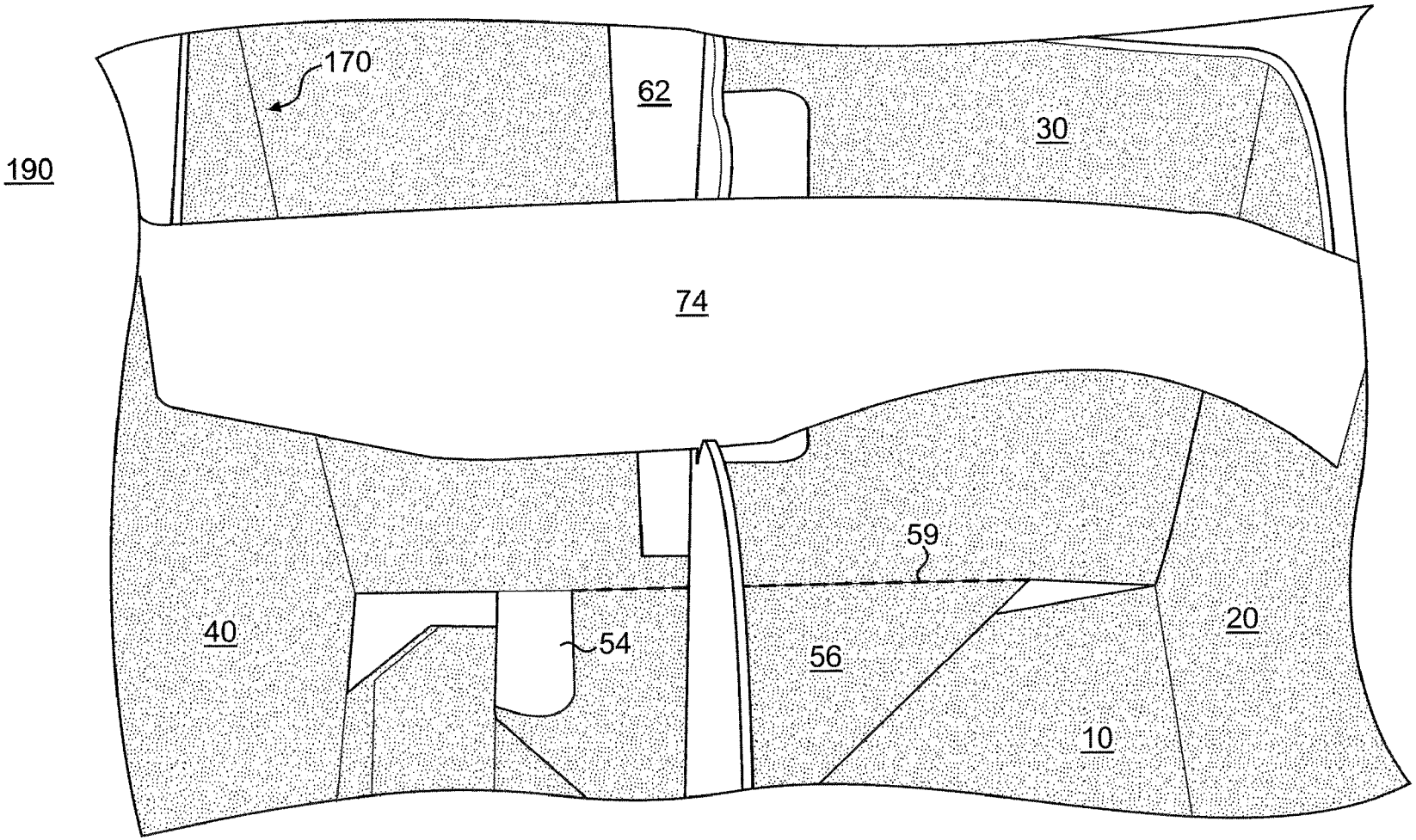
FIG. 12 is a partial view of the interior of the basket carrier.

FIGS. 11 and 12 illustrate the bottom of the interior of the basket carrier 190 on one side of the handle 170. The bottom on the opposite side of the handle 170 is similar or identical in construction due to the symmetric nature of the blank 8 from which the carrier 190 is formed. The web panels 52, 54, 56 of the strap 50 and the web panels 14, 16, 18 serve to reinforce the bottom of the basket carrier 190. On the right end of the illustrated half of the carrier 190, the web panels 52, 54, 56 of the strap 50 are foldably attached to the major handle panel 40 and to the first end panel 30. The panels 52, 54, 56 are thereby securely anchored to support the bottom of the right end of the carrier half section. The web panels 52, 54, 56 are folded so that the web panels 52, 56 are interior side up and the web panel 54 is print side up. In the illustrated embodiment, the web panel 54 is adhered to the web panel 52, although this adhesion is optional.

On the left end of the illustrated half of the carrier 190, the web panels 14, 16, 18 are folded so that the web panel 14 is print side up and the web panels 16, 18 are print side down. The web panel 14 is foldably connected to the bottom panel 10 and the web panel 18 is foldably connected to the second end panel 34. The web panels 14, 16, 18 are thereby securely anchored to support the bottom of the left end of the carrier half section. In the illustrated embodiment, the web panel 14 is adhered to the bottom panel 10, although this adhesion is optional.

According to one aspect of the invention, the web panels 14, 16, 18, 52, 54, 56 extend across the bottom of each carrier half section, overlying and generally parallel with the bottom panels 10. The web panels 14, 16, 18, 52, 54, 56 may be foldably attached to one or more vertical side, end or handle panels of the carrier 190 so that they are securely mounted within the carrier structure. The presence of the web panels 14, 16, 18, 52, 54, 56 extending across the bottom panels 10 increases the load-bearing capacity of the container receptacles of the basket carrier 190.

FIG. 13 illustrates the carrier 190 loaded with bottle beverage containers C, one container in each container receptacle. In the exemplary embodiment, the carrier 190 is illustrated as accommodating twelve 16-ounce petaloid beverage bottle containers C. The containers are arranged in a 2×3 configuration on each side of the basket carrier. Other arrangements of containers, packages, articles, and other items, however, can be accommodated within a basket carrier according to the principles of the present invention. For example, 12 or 20-ounce petaloid bottles or cans may be accommodated within a basket carrier constructed according to the principles of the present invention.

In the exemplary embodiment discussed above, the exemplary blank may be formed from, for example, clay coated newsprint (CCN), solid unbleached sulfate board (SUS), and other materials. In general, the blank may be constructed from paperboard having a caliper such that it is heavier and more rigid than ordinary paper. The blank can also be constructed of other materials, such as cardboard, or any other material having properties suitable for enabling the basket carrier to function at least generally as described above.

The exemplary blank can be coated with, for example, a clay coating. The clay coating may then be printed over with product, advertising, nutritional, and other information or images. The blank may then be coated with a varnish to protect information printed on the blank. The blank may also be coated with, for example, a moisture barrier layer, on either or both sides of the blank. The blank can also be laminated to or coated with one or more sheet-like materials at selected panels or panel sections.

The above embodiments may be described as having one or more panels adhered together by glue. In this specification, the term "glue" is intended to encompass all manner of adhesives commonly used to secure paperboard or similar materials together.

In accordance with the exemplary embodiments, a fold line can be any substantially linear, although not necessarily straight, form of disruption or weakening in the blank that facilitates full or partial bending or folding therealong. More specifically, but not for the purpose of narrowing the scope of the present invention, examples of fold lines include: score lines; crease lines; cut-crease lines; cut-score lines; cut-space lines; and various overlapping and/or sequential combinations of these features. In the exemplary blank embodiment shown in FIGS. 1 and 2, cut-crease and cut-score fold lines are indicated by a light solid line overlapped by spaced heavy dashed lines.

The term "foldably" is used to describe general folding or bending between connected panels. The term does not imply the ability to fold to a large degree, such as, for example, a ninety degree fold. Further, the description "folded flat" does not require an exact 180 degree fold, and allows for bowing, etc. between the folded panels of the blank.

The term "line" as used herein includes not only straight lines, but also other types of lines such as curved, curvilinear or angularly displaced lines, and interrupted lines.

The description is not intended to limit the invention to the form disclosed herein. Also, it is intended that the appended claims be construed to include alternative embodiments, not explicitly defined in the detailed description.

What is claimed is:

1. A basket carrier divided into a first section and a second section, each section having a first end, a second end, and an exterior side, the first section of the carrier comprising:

at least one end panel at the first end;

at least one end panel at the second end;

a side panel at the exterior side;

a bottom panel;

a plurality of separator panels dividing the first section of the carrier into a first plurality of receptacles, the plurality of separator panels comprises at least one longitudinal separator panel and at least a first transverse separator panel and a second transverse separator panel, the first and second transverse separator panels are foldably connected to the side panel; and at least one reinforcing web comprising a first plurality of web panels overlying the bottom panel and connected to at least one of the end panels;

a handle comprises at least one handle panel located between the first and second sections and foldably connected to the at least one end panel at the first end and the at least one end panel at the second end, and at least one of the first plurality of web panels is connected to the at least one handle panel;

the first plurality of web panels comprising a first web panel foldably connected to a bottom edge of the at least one end panel at a first fold line and a second web panel foldably connected to a bottom edge of the at least one handle panel at a second fold line;

the at least one handle panel comprises a first major handle panel, a first interior handle panel at least partially in face-to-face contact with the first major handle panel, and a first exterior handle panel at least partially in face-to-face contact with the first interior handle panel;

the second section of the carrier comprising a second major handle panel at least partially in face-to-face contact with the first major handle panel of the first section, a second interior handle panel at least partially in face-to-face contact with the second major handle panel, and a second exterior handle panel at least partially in face-to-face contact with the second interior handle panel;

the first interior handle panel being foldably connected to the first exterior handle panel along a transverse handle fold line, and the second interior handle panel being foldably connected to the second exterior handle panel along the transverse handle fold line.

2. The basket carrier of claim 1, wherein the first plurality of web panels comprises three foldably connected web panels.

3. The basket carrier of claim 1, wherein the at least one reinforcing web comprises a second plurality of web panels, a web panel of the second plurality of web panels being connected to the bottom panel.

4. The basket carrier of claim 3, wherein the second plurality of web panels is foldably connected to the at least one end panel at the second end.

5. The basket carrier of claim 1, wherein the first plurality of web panels are a first plurality of interconnected web panels extending across the bottom panel and the at least one reinforcing web comprises a second plurality of interconnected web panels extending across the bottom panel.

6. The basket carrier of claim 1, wherein an upper edge of the at least one longitudinal separator panel is curved.

7. The basket carrier of claim 1, wherein the second section of the carrier comprises:

at least one end panel at the first end;

at least one end panel at the second end;

a side panel at the exterior side;

a bottom panel;

and at least one reinforcing web overlying the bottom panel and connected to at least one of the end panels.

8. The basket carrier of claim 1, further comprising a container located in each receptacle.

9. The basket carrier of claim 1, each of the first major handle panel, the second major handle panel, the first interior handle panel, the second interior handle panel, the first exterior handle panel, and the second exterior handle panel comprising a respective handle aperture.

10. The basket carrier of claim 1, the first major handle panel being foldably connected to the second major handle panel, the first interior handle panel being foldably connected to the second interior handle panel, and the first exterior handle panel being foldably connected to the second exterior handle panel.

11. A basket carrier divided into a first section and a second section, each section having a first end, a second end, and an exterior side, the first section of the carrier comprising:

at least one first end panel at the first end;

at least one second end panel at the second end;

a side panel at the exterior side;

a bottom panel;

at least one longitudinal separator panel extending longitudinally through the first section and being attached to the at least one first end panel and the at least one second end panel, the at least one longitudinal separator panel comprising at least one continuous edge extending from the at least one first end panel to the at least one second end panel; and at least one transverse separator panel extending transversely through the first section, a lower edge of the at least one transverse separator panel including at least one concave curved section, an upper edge of the at least one longitudinal separator panel includes at least one convex curved portion and at least one notch, the longitudinal and transverse separator panels divide the first section into a plurality of receptacles, the at least one transverse separator panel comprises an upper edge that is free from contact with the at least one longitudinal separator panel along the length of the at least one transverse separator panel, the at least one transverse separator panel is disposed above the at least one longitudinal separator panel so that the lower edge of the at least one transverse separator panel is in sliding engagement with the upper edge of the at least one longitudinal separator panel for sliding generally longitudinally along a length of the upper edge, a portion of the lower edge of the at least one transverse separator panel engages the at least one notch, and a handle comprises a first major handle panel, a first interior handle panel at least partially in face-to-face contact with the first major handle panel, and a first exterior handle panel at least partially in face-to-face contact with the first interior handle panel;

the second section of the carrier comprises a second major handle panel at least partially in face-to-face contact with the first major handle panel of the first section, a second interior handle panel at least partially in face-to-face contact with the second major handle panel, and a second exterior handle panel at least partially in face-to-face contact with the second interior handle panel;

the first interior handle panel being foldably connected to the first exterior handle panel along a transverse handle fold line, and the second interior handle panel being foldably connected to the second exterior handle panel along the transverse handle fold line.

12. The basket carrier of claim 11, wherein the at least one convex curved portion of the upper edge of the longitudinal separator panel comprises a plurality of arched sections.

13. The basket carrier of claim 12, wherein the arched sections are separated by the at least one notch.

14. The basket carrier of claim 11, wherein the second section of the carrier comprises:

at least one end panel at the first end;

at least one end panel at the second end;

a side panel at the exterior side;

a bottom panel;

and at least one reinforcing web overlying the bottom panel and connected to at least one of the end panels.

15. The basket carrier of claim 11, further comprising a container located in each receptacle.

16. The basket carrier of claim 11, the at least one transverse separator panel comprising a unitary transverse separator panel foldably connected to the at least one exterior handle panel at a first fold line and foldably connected to the side panel at a second fold line, and the at least one longitudinal separator panel comprising a unitary longitudinal separator panel foldably connected to the at least one second end panel at a third fold line and attached to the at least one first end panel.

17. The basket carrier of claim 11, each of the first major handle panel, the second major handle panel, the first interior handle panel, the second interior handle panel, the first exterior handle panel, and the second exterior handle panel comprising a respective handle aperture.

18. The basket carrier of claim 11, the first major handle panel being foldably connected to the second major handle panel, the first interior handle panel being foldably connected to the second interior handle panel, and the first exterior handle panel being foldably connected to the second exterior handle panel.

19. A blank for forming a basket carrier divided into a first carrier section and a second carrier section, the blank having a first blank section for forming the first carrier section and a second blank section for forming the second carrier section, the first blank section comprising:

a first end panel;

a second end panel;

a side panel foldably connected to the first end panel and the second end panel;

a bottom panel foldably connected to the side panel;

at least one longitudinal separator panel foldably connected to the second end panel for dividing the first carrier section into a first plurality of receptacles;

at least a first transverse separator panel and a second transverse separator panel, the first and second transverse separator panels are foldably connected to the side panel;

at least one handle panel foldably connected to the first end panel and the second end panel, at least one reinforcing web comprising a first plurality of web panels, at least one of the first plurality of web panels being foldably connected to a bottom edge of the first end panel at a first fold line, and at least one of the first plurality of web panels being foldably connected to a bottom edge of the at least one handle panel at a second fold line;

the at least one handle panel comprises a first major handle panel, a first interior handle panel for being positioned at least partially in face-to-face contact with the first major handle panel, and a first exterior handle panel for being positioned at least partially in face-to-face contact with the first interior handle panel;

the second blank section comprising a second major handle panel for being positioned at least partially in face-to-face contact with the first major handle panel of the first blank section, a second interior handle panel for being positioned at least partially in face-to-face contact with the second major handle panel, and a second exterior handle panel for being positioned at least partially in face-to-face contact with the second interior handle panel;

the first interior handle panel being foldably connected to the first exterior handle panel along a transverse handle fold line, and the second interior handle panel being foldably connected to the second exterior handle panel along the transverse handle fold line.

20. The blank of claim 19, the first major handle panel being foldably connected to the second major handle panel, the first interior handle panel being foldably connected to the second interior handle panel, and the first exterior handle panel being foldably connected to the second exterior handle panel.

* * * * *